United States Patent [19]

Billet

[11] 4,254,493

[45] Mar. 3, 1981

[54] QUICK HOUR SETTING SYSTEM FOR TIMEPIECE

[75] Inventor: Alain Billet, Besancon, France

[73] Assignee: Timex Corporation, Waterbury, Conn.

[21] Appl. No.: 108,902

[22] Filed: Dec. 31, 1979

[51] Int. Cl.[3] ..... G04C 3/14; G04B 27/00; G04B 13/00

[52] U.S. Cl. ..... 368/185; 368/76; 368/80; 368/196; 368/220

[58] Field of Search ..... 368/76, 80, 185, 197, 368/196, 220

[56] References Cited

U.S. PATENT DOCUMENTS

| | | | |
|---|---|---|---|
| 2,036,050 | 3/1936 | Kenerson | 368/220 |
| 3,019,594 | 2/1962 | Sundt | 368/185 |
| 3,043,090 | 7/1962 | Sundt | 368/185 |
| 3,184,909 | 5/1965 | Lohf et al. | 368/220 |
| 3,498,045 | 3/1970 | Kemenczky | 368/220 |

*Primary Examiner*—Stanley J. Witkowski
*Assistant Examiner*—Forester W. Isen
*Attorney, Agent, or Firm*—William C. Crutcher

[57] ABSTRACT

A watch having epicyclic speed reduction gearing to drive the hour hand from the minute hand with quick hour setting device to change the hour hand without affecting the timekeeping function being measured by the minute hand.

4 Claims, 2 Drawing Figures

QUICK HOUR SETTING SYSTEM FOR TIMEPIECE

BACKGROUND OF THE INVENTION

This invention relates to timepiece of the type having a minute hand staff, which in turn drives the hour hand through a speed reducing gear train. More particularly, it relates to an epicyclic speed reducing gear train with means to adjust the position of the hour hand without affecting the setting or timekeeping function performed by the minute hand, while it is still being driven by the driving device of the timepiece.

In a timepiece, it is desirable to be able to change the hour indicated by the hour hand without disturbing the position of the minute hand or affecting the timekeeping of the watch. These changes are necessary when traveling between time zones, or adjusting between standard time and daylight saving time.

There are many types of conventional watch mechanisms for manually correcting the hour hand without disturbing the timekeeping of the watch. Exemplary of these are the following U.S. patents.

U.S. Pat. No. 3,468,122—Lee—Sept. 23, 1969
U.S. Pat. No. 3,693,344—Cleusix—Sept. 26, 1972
U.S. Pat. No. 3,722,027—Challandes—Mar. 27, 1973
U.S. Pat. No. 3,972,178—Beguin—Aug. 3, 1976
U.S. Pat. No. 3,766,730—Kishida—Oct. 23, 1973

Speed reducing gear trains for timepieces have been proposed using epicyclic gearing to provide a 1:12 speed reduction between the hour hand and the minute hand, the following U.S. patents being exemplary:

U.S. Pat. No. 2,036,050—Kenerson—Mar. 31, 1936
U.S. Pat. No. 3,043,089—Sundt—July 10, 1962
U.S. Pat. No. 3,043,090—Sundt—July 10, 1962

However, these proposals do not suggest a mechanism for setting the hour hand unless the minute hand is also set at the same time. It would be desirable to have a simplified speed reduction mechanism for driving the hour hand from the minute hand staff in a timepiece employing a motor to drive the minute hand, which also permits quick and separate setting of the hour hand without disturbing the setting or timekeeping function of the minute hand of the timepiece. Such speed reduction gear train should be suitable for driving with a stepping motor, as used in modern quartz analog wrist watches.

Accordingly, one object of the present invention is to provide an improved quick hour setting system for a timepiece.

Another object of the invention is to provide an improved epicyclic speed reduction gear train for a stepping motor timepiece with provision for quickly setting the hour hand without distrubing the timekeeping function of the timepiece.

DRAWINGS

The invention, both as to organization and method of practice, together with further objects and advantages thereof, will best be understood by reference to the following specification, taken in connection with the accompanying drawings, in which:

FIG. 1 is a simplified schematic elevation view of the speed reduction gearing of a timepiece, and FIG. 2 is a plan view of the timepiece of FIG. 1.

SUMMARY OF THE INVENTION

Briefly stated, the invention is practiced by providing in a timepiece with a motor driving a minute hand staff, the improvement comprising an epicyclic gear train driving an hour hand spindle, a selectively rotatable hour setting wheel, and guiding means operatively connected between portions of the epicyclic gear train and the setting wheel to enable operation of the epicyclic gear train, the guiding means being rotatable along with the setting wheel. In its preferred from the epicyclic gear train includes a gear which is moved inside a toothed annulus by an eccentric on the minute wheel staff, with the guiding means enabling oscillatory motion of the gear.

DESCRIPTION OF THE PREFERRED EMBODIMENT

Figure 1:
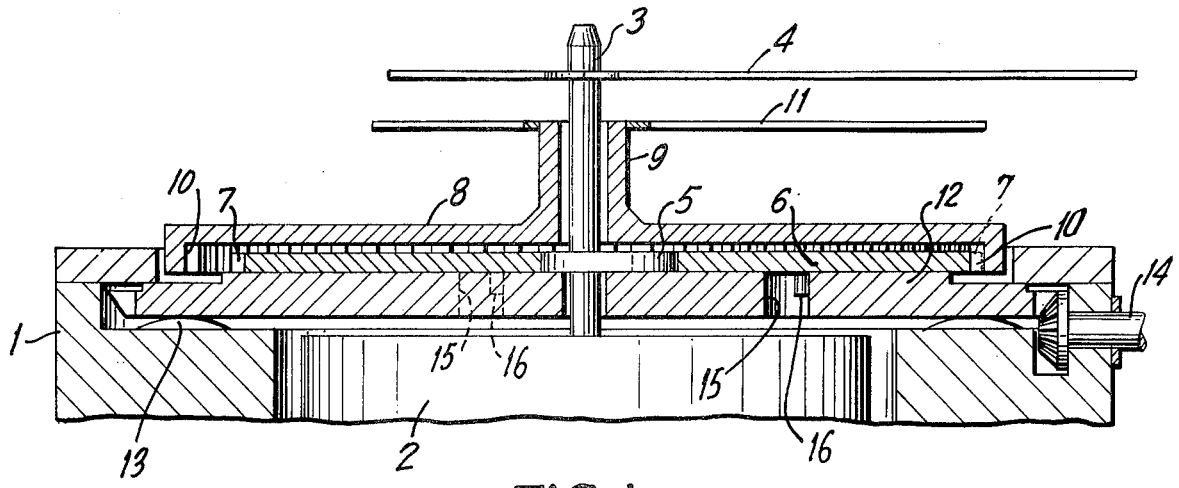

Referring now to FIG. 1 of the drawing, a timepiece comprises a case 1, containing a stepping motor 2 connected to drive a staff 3, on which is disposed a minute hand 4. The stepping motor may be one of any conventional type driven by electronic pulses supplied by an integrated circuit, whose frequency is controlled by a quartz crystal. The type of stepping motor or rocking motor is not material to the present invention, but suitable motors are disclosed in U.S. Pat. No. 4,079,279 issued Mar. 14, 1978 to Oudet et al. The circuitry of the stepping motor may also include provision for fast advance of the minute hand for purpose of time setting.

The minute hand staff includes an eccentric member 5. A gear 6 which is rotatable about the axis of eccentric 5 has external teeth 7. An annulus 8 includes a hollow spindle 9 coaxial with the minute staff. The annulus 8 includes internal teeth 10 meshing with the external teeth 7 of gear 6. An hour hand 11 is attached to the spindle 9. Together the annulus 8, the gear 6 and the eccentric 5 comprise an epicyclic gear train of the type disclosed in the prior art mentioned above. Disposed in the case 1 is a selectively rotatable hour setting wheel 12, held by frictional engagement against bearing surfaces 13. Means to manually rotate the wheel 12 by means of a crown (not shown) is enabled through a stem and pinion 14 having bevelled gear teeth. The friction of the bearing surfaces 13 and the pinion 14 hold the setting wheel 12 in place unless it is intentionally rotated.

The setting wheel 12 has a plurality of openings 15 in which are disposed pins 16 attached to the gear. The effective clearance for the pins 16 within holes 15, i.e. diameter of hole less diameter of pin, is equal to or greater than the eccentricity of the gear 6 with respect to minute wheel staff 3. The pins may move in a circular direction inside the holes to perform a guiding function for the gear 6. The pins and holes thereby provide a guiding means to enable a oscillatory motion of gear 6.

Figure 2:
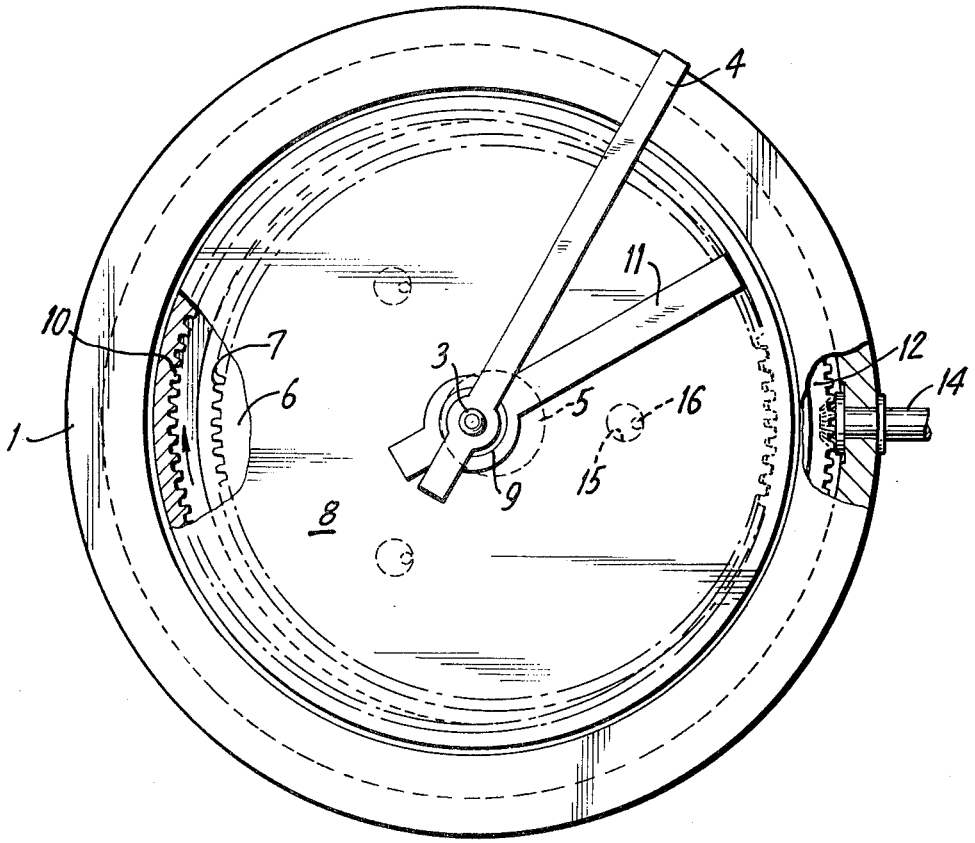

Operation of the epicyclic gear train both during normal timekeeping and during quick hour setting will now be described. Referring to FIGS. 1 and 2 of the drawing, stepping motor 2 rotates the minute wheel staff 3 and minute hand 4, causing the eccentric portion 5 to rotate around the minute staff axis. Since the setting wheel 12 is fixed, gear 6 does not rotate about its own axis, but rather undergoes an oscillatory motion which is guided by the pins 16 in holes 15. As gear 6 oscillates, teeth 7 mesh with annulus teeth 10 causing the annulus to rotate clockwise at a reduced rate determined by the ratio of the number of teeth 7 to the number of teeth 10.

This speed reduction rate is 1:12 as determined by well-known formulas. For example, if the number of internal teeth is 12, the number of external teeth should be 11. In this way, one complete oscillation of gear 6 will advance the annulus 8 by one tooth or 1/12 of a revolution. Therefore the hour hand will advance by 1/12 of the dial of the timepiece as the minute hand makes a complete revolution.

Operation of the quick hour setting feature is as follows: Rotation of the stem 14 causes the setting wheel 12 to rotate. This causes the gear 6 to rotate about its own axis, i.e. about the center of the eccentric portion 5. The pins 16 and holes 15 move together with setting wheel 12 and gear 6 without changing relative positions.

This rotation of gear 6 about its own axis does not affect the position of the minute hand staff in any way. Rotation of gear 6 about its axis rotates the annulus 10, hour hand spindle and hour hand 11 with respect to the axis of the minute staff 3 without moving the minute hand.

For the proper relationships to exist, as can be computed by consulting suitable texts on kinematics, it is necessary to rotate gear 6 for 1/11 of an revolution about its axis in order to change the hour hand position by 1/12 of a revolution on the timepiece dial. This is due to the absolute versus the relative angular displacements of minute hand 4 and hour hand 11.

The foregoing improvement provides ability to quickly change the hour by rotating setting wheel 12. Rotation of setting wheel 12 can also be accomplished by a stepping or ratchet mechanism also rather than through a gear pinion so as to facilitate advancing wheel 12 precisely by one hour. Also, it should be apparent that the relative positions of pins 16 and holes 15 on gear 6 and setting wheel 12 can be reversed so that the pins are on the setting wheel and the holes are in the gear. The epicyclic gear train provides a simple means for reducing the speed of the minute hand staff to drive the hour hand staff and also to provide a quick hour setting system as described.

While there has been described what is considered to be the preferred embodiment of the invention, other modifications will occur to those skilled in the art, and it is desired to secure by the appended claims all such modifications as fall within the true spirit and scope of the invention.

What is claimed as new is:

1. In a timepiece having a motor operatively connected to drive a minute hand staff with a minute hand thereon, and also having an hour hand spindle coaxial with said staff and having an hour hand thereon, the improvement comprising:

an epicyclic gear train operatively connected between said staff and said spindle to drive the spindle at reduced speed, a setting wheel selectively rotatable about said staff, guiding means operatively connected between portions of the epicyclic gear train and the setting wheel and adapted to enable operation of the gear train, said guiding means being selectively rotatable with the setting wheel to permit setting of the hour hand only.

2. In a timepiece having a motor operatively connected to drive a minute hand staff with a minute hand thereon, and also having an hour hand spindle coaxial with said staff and having an hour hand thereon, the improvement comprising:

an eccentric member on said minute hand staff, a gear member rotatable around said eccentric member and having external gear teeth, an annulus attached to said hour hand spindle and having internal teeth meshing with said external gear teeth to provide an epicyclic speed reduction gear train to drive the hour hand spindle from the minute hand staff, a setting wheel coaxial with said annulus and selectively rotatable around the minute wheel staff, and guiding means operatively connected between the setting wheel and the gear and adapted to permit normally only oscillatory motion of the gear when the eccentric member is rotated, said guiding means being selectively rotatable along with the setting wheel.

3. The combination according to claim 1, wherein said guiding means comprises a plurality of pins projecting from said gear into holes defined in said setting wheel.

4. The combination according to claim 1 wherein said guiding means comprises a plurality of pins projecting from said setting wheel into holes defined in said gear.

* * * * *